US008578715B2

(12) United States Patent
Iwasaki et al.

(10) Patent No.: US 8,578,715 B2
(45) Date of Patent: Nov. 12, 2013

(54) GAS TURBINE, METHOD OF CONTROLLING AIR SUPPLY AND COMPUTER PROGRAM PRODUCT FOR CONTROLLING AIR SUPPLY

(75) Inventors: Yoichi Iwasaki, Hyogo (JP); Yoshifumi Iwasaki, Hyogo (JP); Shinichi Yoshioka, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 13/045,055

(22) Filed: Mar. 10, 2011

(65) Prior Publication Data

US 2011/0154826 A1 Jun. 30, 2011

Related U.S. Application Data

(62) Division of application No. 11/366,509, filed on Mar. 3, 2006, now Pat. No. 7,987,660.

(30) Foreign Application Priority Data

Jun. 10, 2005 (JP) ..... 2005-171454
Jun. 10, 2005 (JP) ..... 2005-171455

(51) Int. Cl.
*F02C 7/12* (2006.01)

(52) U.S. Cl.
USPC ..... 60/755; 60/752

(58) Field of Classification Search
USPC ..... 60/794, 39.27, 803, 39.23, 752, 755, 60/759
See application file for complete search history.

(56) References Cited

U.S. PATENT DOCUMENTS 4,903,477 A 2/1990 Butt
5,107,673 A 4/1992 Sato et al.
5,490,378 A 2/1996 Berger et al.
6,202,400 B1 3/2001 Utamura et al.
6,250,061 B1 * 6/2001 Orlando ..... 60/772

(Continued)

FOREIGN PATENT DOCUMENTS

JP 06-026364 A 2/1994
JP 2001-289005 A 10/2001

(Continued)

OTHER PUBLICATIONS

Notice of Allowance issued Sep. 26, 2011, in corresponding U.S. Appl. No. 13/045,098.

(Continued)

*Primary Examiner* — Phutthiwat Wongwian
*Assistant Examiner* — Vikansha Dwivedi
(74) *Attorney, Agent, or Firm* — Westerman, Hattori, Daniels & Adrian, LLP

(57) ABSTRACT

The present invention provides a gas turbine capable of reducing energy consumption while suppressing a so-called cat back phenomenon. The gas turbine includes a combustor-accommodating chamber casing for accommodating therein a combustor which burns fuel and air compressed by a compressor to generate combustion gas and which injects the combustion gas to a turbine. The gas turbine also includes a first air supply passage and a second air supply passage on an upper portion of the combustor-accommodating chamber casing in the vertical direction. The first air supply passage discharges air toward the compressor in the combustor-accommodating chamber casing. The second air supply passage discharges air in a direction different from that of the first air supply passage.

5 Claims, 10 Drawing Sheets

(56) References Cited

U.S. PATENT DOCUMENTS

| | | | | |
|---|---|---|---|---|
| 6,478,534 | B2 | 11/2002 | Bangert et al. | |
| 6,633,828 | B2 | 10/2003 | Faymon et al. | |
| 6,978,622 | B2 | 12/2005 | Dittmann et al. | |
| 7,000,404 | B2 * | 2/2006 | Palmisano et al. | 60/782 |

FOREIGN PATENT DOCUMENTS

| | | | |
|---|---|---|---|
| JP | 2003-254010 | A | 9/2003 |
| JP | 2004-218569 | A | 8/2004 |
| WO | 00-11324 | A1 | 3/2000 |
| WO | 03-038242 | A1 | 5/2003 |
| WO | 03/038243 | A1 | 5/2003 |

OTHER PUBLICATIONS

German Office Action dated Mar. 7, 2011, issued in corresponding German Patent Application No. 102006024968.2.

US Office Action (Notice of Allowance) dated May 3, 2011, issued in corresponding U.S. Appl. No. 11/366,509.

Chinese Office Action mailed Aug. 24, 2007, issued in corresponding Chinese Patent Application No. 2006100683013.

German Office Action dated Oct. 23, 2009, issued in corresponding German Patent Application No. 10 2006 024 968.2.

* cited by examiner

GAS TURBINE, METHOD OF CONTROLLING AIR SUPPLY AND COMPUTER PROGRAM PRODUCT FOR CONTROLLING AIR SUPPLY

CROSS-REFERENCE TO RELATED APPLICATIONS

This is a divisional application of Ser. No. 11/366,509 filed on Mar. 3, 2006 which claims priority rights of Japanese patent Application No. 2005-171454 filed on Jun. 10, 2005 and Japanese patent Application No. 2005-171455 filed on the same date, and the entire contents of these applications are incorporated in the present application.

BACKGROUND OF THE INVENTION

1. Field of the Invention

The present invention relates to a gas turbine, a method of controlling air supply and a computer program product for controlling air supply.

2. Description of the Related Art

The gas turbine is operated by injecting high temperature gas generated by a combustor to a turbine. After the operation of the gas turbine is stopped, the high temperature gas stays in a combustor-accommodating chamber in which the combustor is accommodated, and a temperature difference is generated in an upper half and a lower half of the combustor-accommodating chamber. An upper side of the combustor-accommodating chamber having high temperature expands, and a lower side of the combustor-accommodating chamber having low temperature relatively contracts. Therefore, the combustor-accommodating chamber is deformed and a so-called cat back phenomenon is generated. To suppress the cat back phenomenon, Japanese Patent Application Laid-Open No. 2004-218569 discloses in its paragraph 0004 a technique (abbreviated as spin cooling, hereinafter) in which to reduce the temperature difference in a combustor-accommodating chamber 5, a turbine blade is rotated after the operation of the gas turbine is stopped to generate air current in the combustor-accommodating chamber, and temperature distribution in the combustor-accommodating chamber is reduced.

According to the technique disclosed in the above Japanese Patent Application, however, power for rotating the turbine blade after the operation of the gas turbine is stopped is necessary, and there is a problem that energy consumption for the power is high. The above Japanese Patent Application also discloses a technique to keep flowing purge air into the combustor-accommodating chamber, but this technique requires to continuously flow the purge air for a long time, and this technique is susceptible to improvement for reduction of energy consumption.

SUMMARY OF THE INVENTION

The present invention has been achieved in order to solve the above problems. It is an object of this invention to provide a gas turbine, a method of controlling air supply and a computer program product for controlling air supply capable of reducing energy consumption while suppressing a so-called cat back phenomenon.

According to one aspect of the present invention, the gas turbine includes a combustor-accommodating chamber for accommodating therein a combustor which burns fuel and air compressed by a compressor to generate combustion gas and which injects the combustion gas to a turbine; first air supply means provided on an upper portion of the combustor-accommodating chamber in a vertical direction for discharging air toward the compressor in the combustor-accommodating chamber; and second air supply means provided on the upper portion of the combustor-accommodating chamber in a vertical direction for discharging air into the combustor-accommodating chamber in a direction different from that of the first air supply means.

According to another aspect of the present invention, the gas turbine includes a combustor-accommodating chamber for accommodating therein a combustor which burns fuel and air compressed by a compressor to generate combustion gas and which injects the combustion gas to a turbine; and air layer forming means provided on the inner wall surface of the combustor-accommodating chamber on the side of its upper portion in the vertical direction for discharging air along an inner wall surface of the upper side of the combustor-accommodating chamber in the vertical direction.

According to still another aspect of the present invention, the method of controlling air supply for supplying air into a combustor-accommodating chamber which accommodates a combustor therein after operation of a gas turbine is stopped, the method includes obtaining temperature of an upper portion of the combustor-accommodating chamber in a vertical direction and temperature of a lower portion of the combustor-accommodating chamber in the vertical direction; obtaining a difference between the temperature of the upper portion of the combustor-accommodating chamber in the vertical direction and the temperature of the lower portion of the combustor-accommodating chamber in the vertical direction; adjusting an amount of air to be discharged into the combustor-accommodating chamber such that the difference between the temperature of the upper portion of the combustor-accommodating chamber in the vertical direction and the temperature of the lower portion of the combustor-accommodating chamber in the vertical direction falls within a predetermined range; and discharging air into the combustor-accommodating chamber with the adjusted flow rate.

According to still another aspect of the present invention, a computer program product for controlling air supply having a computer readable medium including programmed instructions for supplying air into a combustor-accommodating chamber which accommodates a combustor therein after operation of a gas turbine is stopped, wherein the instructions, when executed by a computer, cause the computer to perform obtaining temperature of an upper portion of the combustor-accommodating chamber in a vertical direction and temperature of a lower portion of the combustor-accommodating chamber in the vertical direction; obtaining a difference between the temperature of the upper portion of the combustor-accommodating chamber in the vertical direction and the temperature of the lower portion of the combustor-accommodating chamber in the vertical direction; adjusting an amount of air to be discharged into the combustor-accommodating chamber such that the difference between the temperature of the upper portion of the combustor-accommodating chamber in the vertical direction and the temperature of the lower portion of the combustor-accommodating chamber in the vertical direction falls within a predetermined range; and discharging air into the combustor-accommodating chamber with the adjusted flow rate.

According to the gas turbine, the method of controlling air supply and the computer program product for controlling air supply, energy consumption can be reduced while suppressing the so-called cat back phenomenon.

DETAILED DESCRIPTION OF THE PREFERRED EMBODIMENTS

The present invention will be explained in detail with reference to the drawings. The invention is not limited to the best modes (embodiments, hereinafter) for carrying out the invention. Constituent elements in the following embodiments include those which can easily be achieved by a person skilled in the art, and those which are substantially the same.

First Embodiment

The first embodiment is characterized in that air is discharged from first air supply means provided on an upper portion of a combustor-accommodating chamber of a gas turbine in the vertical direction toward a compressor disposed inside of the casing, and air is discharged from a second air supply means provided on an upper portion of the combustor-accommodating chamber in the vertical direction toward a direction different from the first air supply means.

Figure 1:
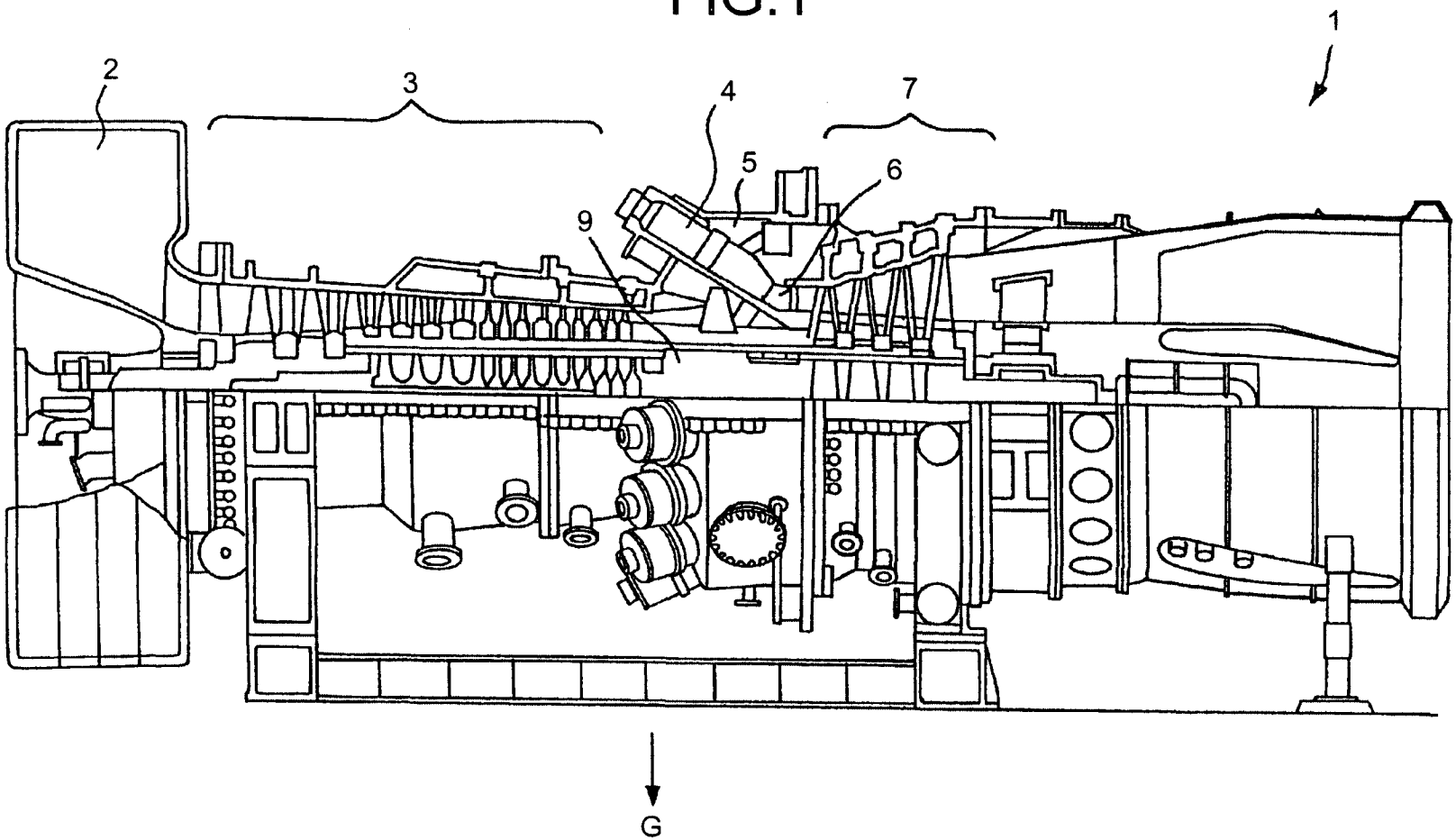
FIG. 1 is an explanatory view showing a gas turbine.

FIG. 1 is an explanatory view showing the gas turbine. The gas turbine 1 is disposed horizontally. That is, in the gas turbine 1, a rotor shaft 9 on which a rotor disk and a moving blade are mounted is disposed in the vertical direction, i.e., perpendicularly to a gravity application direction (direction of the arrow G in FIG. 1) substantially at right angles. Air taken from the air intake 2 is compressed by a compressor 3, and becomes high temperature and high pressure compressed air and is sent to a combustor 4 disposed in the combustor-accommodating chamber 5. In the combustor 4, gas fuel such as natural gas or liquid fuel such as light oil is supplied into the compressed air and burned, thereby producing high temperature and high pressure combustion gas. The high temperature and high pressure combustion gas is introduced into a combustor tail covert 6 and injected into the turbine 7.

Figure 2:
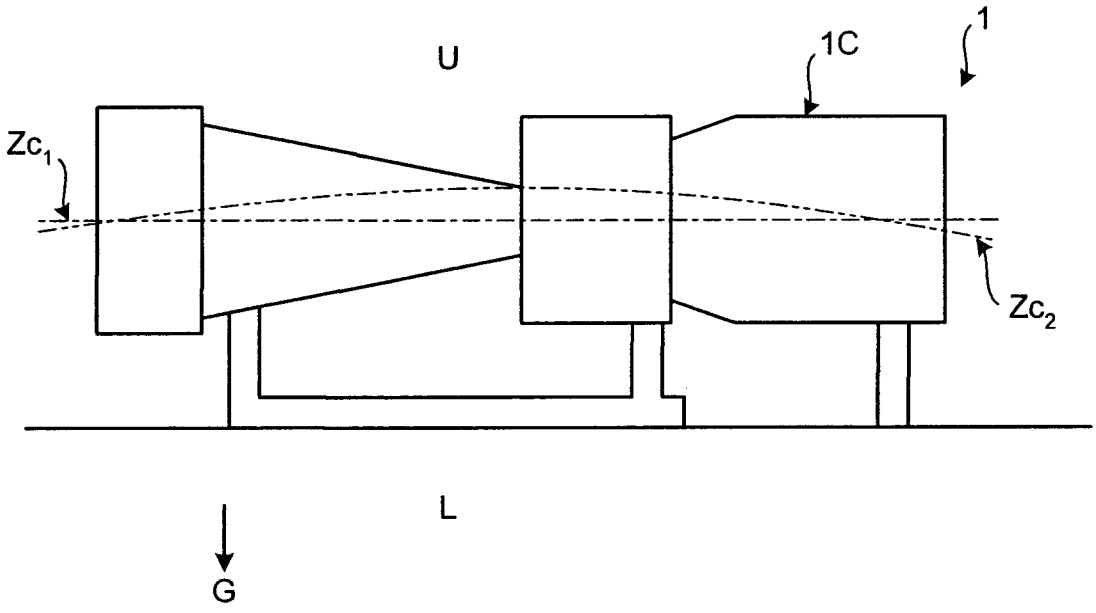
FIG. 2 is an explanatory view showing a so-called cat back phenomenon.

FIG. 2 is an explanatory view showing a so-called cat back phenomenon. In FIG. 2, reference symbols $Zc_1$ and $Zc_2$ show center axes, and $Zc_1$ is the center axis during operation of the gas turbine 1, and $Zc_2$ is the center axis after operation of the gas turbine 1. During the operation of the gas turbine 1, a temperature distribution of the casing 1C of the gas turbine 1 is relatively small due to rotations of the compressor 3 and the turbine 7.

If the operation of the gas turbine 1 is completed, rotations of the compressor 3 and the turbine 7 are stopped. As a result, high temperature gas is concentrated on an upper portion U of the gas turbine 1 in the vertical direction, and relatively low temperature gas is concentrated on a lower portion L of the gas turbine 1 on the contrary. With this, the length of the casing 1C is increased in the upper portion U in the vertical direction as compared with the lower portion L in the vertical direction, the upper portion U of the casing 1C in the vertical direction is warped to assume a shape of a cat's back. This is called cat back phenomenon.

If the cat back phenomenon is generated, the center axis $Zc_2$ of the casing 1C after the operation of the gas turbine 1 is curved and deviated with respect to the center axis $Zc_1$ of the casing 1C during the operation of the gas turbine 1. The center axis $Zc_1$ of the casing 1C during the operation of the gas turbine 1 is substantially in parallel to the rotation shaft of the gas turbine 1. Therefore, if the cat back phenomenon is generated, there is an adverse possibility that the moving blade attached to the rotor and the casing 1C come into contact with each other. Here, the vertical direction is a direction in which gravity is applied. The upper portion U in the vertical direction is opposite side from the gravity applying direction G, and the lower portion L in the vertical direction is on the side of the gravity applying direction. Hereinafter, the upper portion in the vertical direction is simply called upper portion, and the lower portion in the vertical direction is simply called lower portion.

Figure 3:
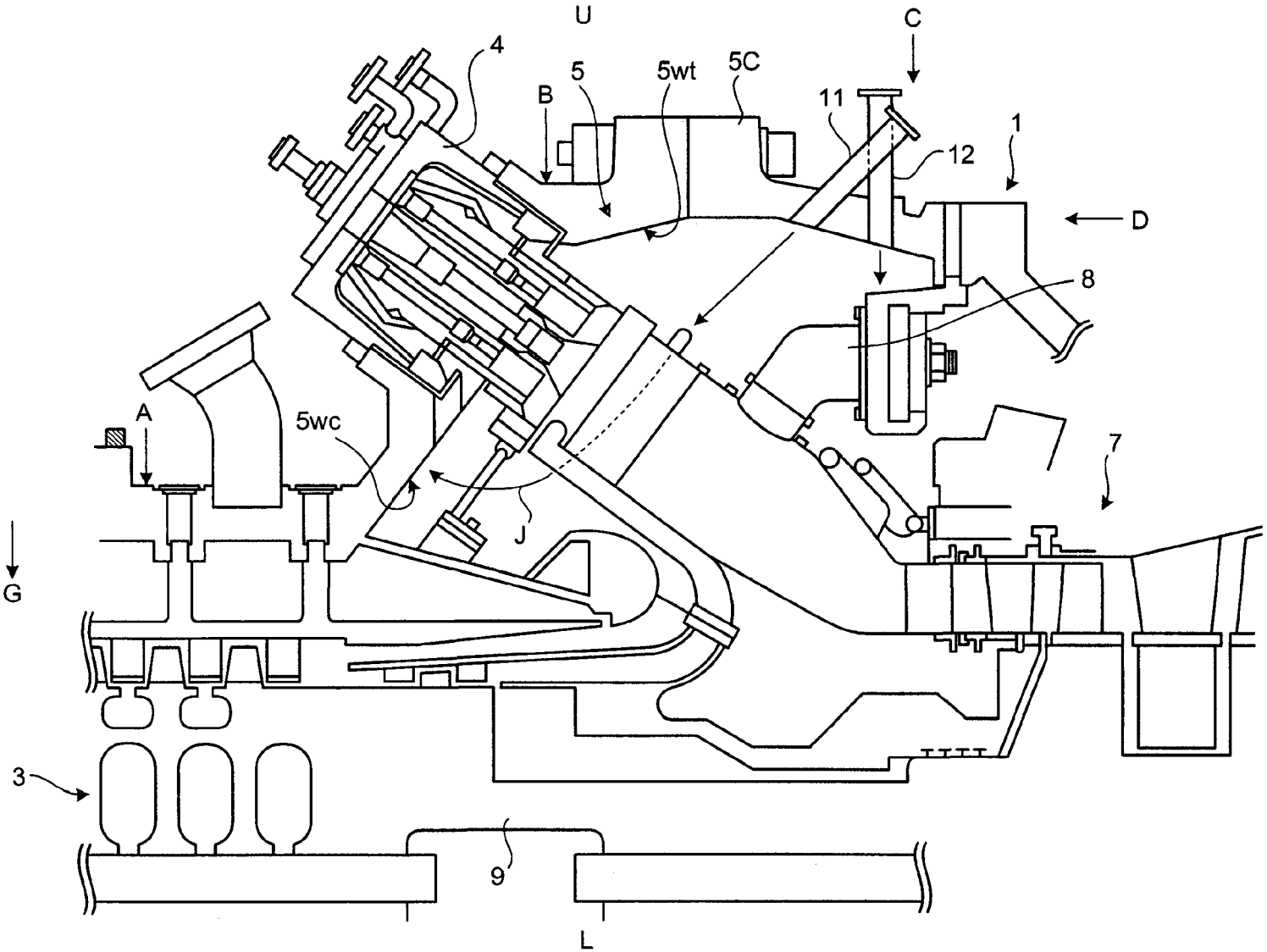
FIG. 3 is a partial sectional view showing a combustor-accommodating chamber portion of the gas turbine according to a first embodiment.
Figure 4:
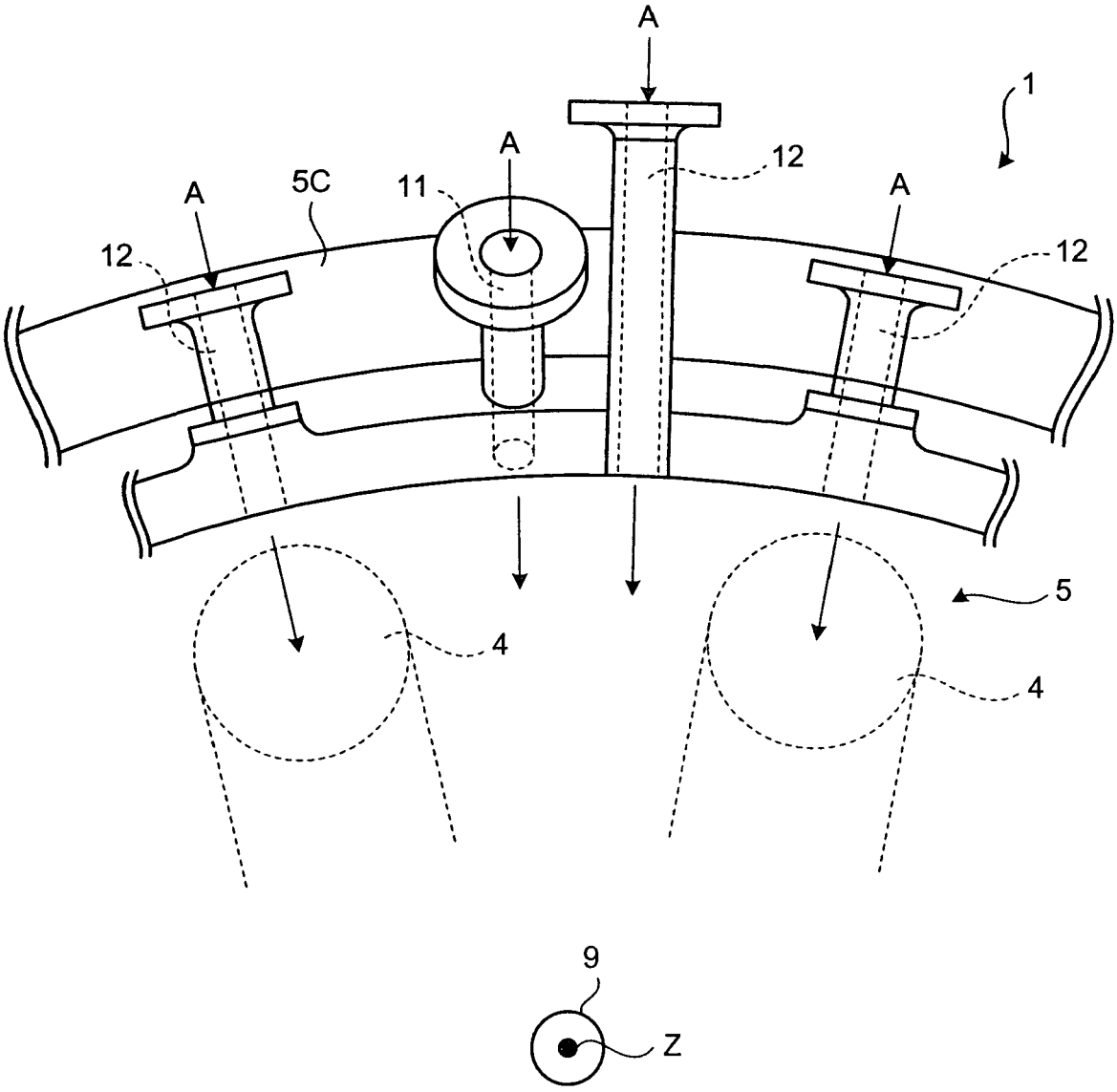
FIG. 4 is an explanatory view of an inside of a combustor-accommodating chamber as viewed from a direction of the arrow D in FIG. 3.

To suppress the cat back phenomenon, in the gas turbine 1 of the first embodiment, the following structure is employed. FIG. 3 is a partial sectional view showing a combustor-accommodating chamber portion of the gas turbine according to the first embodiment. FIG. 4 is an explanatory view of an inside of a combustor-accommodating chamber as viewed from a direction of the arrow D in FIG. 3. As shown in FIGS. 3 and 4, the gas turbine 1 includes first air supply means (first air supply passage, hereinafter) 11 for discharging air into the combustor-accommodating chamber 5, and second air supply means (second air supply passage, hereinafter) 12. The first air supply passage 11 and the second air supply passage 12 are provided on the side of the upper portion U of the combustor-accommodating chamber 5.

As shown in FIG. 3, a direction (passage axial direction) of the first air supply passage 11 is inclined with respect to the rotor shaft 9 of the gas turbine 1. The first air supply passage 11 is formed from outside toward inside of the combustor-accommodating chamber casing 5C and toward the compressor 3. A direction (passage axial direction) of the second air supply passage 12 is formed perpendicular to the rotor shaft 9 of the gas turbine 1 substantially at right angles. As shown in FIG. 4, directions of the first and second air supply passages 11 and 12 are directed to a rotation center axis Z of the rotor shaft 9 (i.e., rotation center axis of the turbine 7).

As shown in FIGS. 3 and 4, the second air supply passage 12 discharge air A toward the lower portion (i.e., on the side of the gravity applying direction) U of the combustor-accommodating chamber. The air A stirs high temperature air staying on the side of the upper portion U of the combustor-accommodating chamber 5, thereby reducing deviation in temperature generated in the combustor-accommodating chamber casing 5C. This effect is especially high in a cross section where the second air supply passage 12 is provided.

On the other hand, the first air supply passage 11 discharges air A toward the combustor 4 and the compressor 3. Here, as shown in FIG. 4, in a cross section perpendicular to the rotation center axis Z of the rotor shaft 9, the first air supply passage 11 is disposed such that the first air supply passage 11 discharges air A toward a space between the combustors 4. With this, the air A discharged from the first air supply passage 11 into the combustor-accommodating chamber 5 passes between the combustors 4 and reaches the combustor-accommodating chamber inner wall (compressor-side combustor-accommodating chamber inner wall) 5*wc* on the side of the compressor 3 of the combustor-accommodating chamber 5. That is, a direction in which the first air supply passage 11 discharges air into the combustor-accommodating chamber 5 and a direction in which the second air supply passage 12 discharges air into the combustor-accommodating chamber 5 are different from each other.

With this, high temperature air staying on the side of the upper portion U of the combustor-accommodating chamber 5 is stirred, and air near the compressor-side combustor-accommodating chamber inner wall 5*wc* is also stirred (arrow J in FIG. 3). It is possible to reduce deviation in temperature generated in the combustor-accommodating chamber casing 5C also in a place away from a cross section where the first and second air supply passages 11 and 12 are provided. As a result, since the deviation in temperature can be reduced over the entire combustor-accommodating chamber casing 5C, it is possible to effectively suppress the cat back phenomenon with small energy.

According to the gas turbine 1 of this embodiment, in a cross section of the combustor-accommodating chamber 5 on the side of the compressor 3 (cross section shown with the arrow A in FIG. 3), the temperature difference (difference between upper and lower temperatures) between the upper portion U and lower portion L of the combustor-accommodating chamber 5 could be reduced by about 15° C. as compared with the spin cooling. In a cross section (cross section shown with the arrow B in FIG. 3) near a flange of the combustor-accommodating chamber 5, the upper and lower temperature difference could be reduced by about 40° C. as compared with the spin cooling. In a cross section (cross section shown with the arrow C in FIG. 3) on the side of the turbine of the combustor-accommodating chamber 5, the upper and lower temperature difference could be reduced by about 80° C. as compared with the spin cooling.

In this embodiment, the combustor-accommodating chamber of the gas turbine includes the first air supply means formed by inclining toward the compressor side and the second air supply means formed perpendicular to the rotor shaft of the gas turbine substantially at right angles. With this, deviation in temperature can be suppressed over the entire combustor-accommodating chamber casing and thus, the cat back phenomenon can effectively be suppressed with small energy. Although air is discharged into the combustor-accommodating chamber from the upper portion thereof in this embodiment, air may also be discharged from the lower portion side of the combustor-accommodating chamber i.e. the lower portion side of the combustor into the combustor-accommodating chamber.

Second Embodiment

Figure 5:
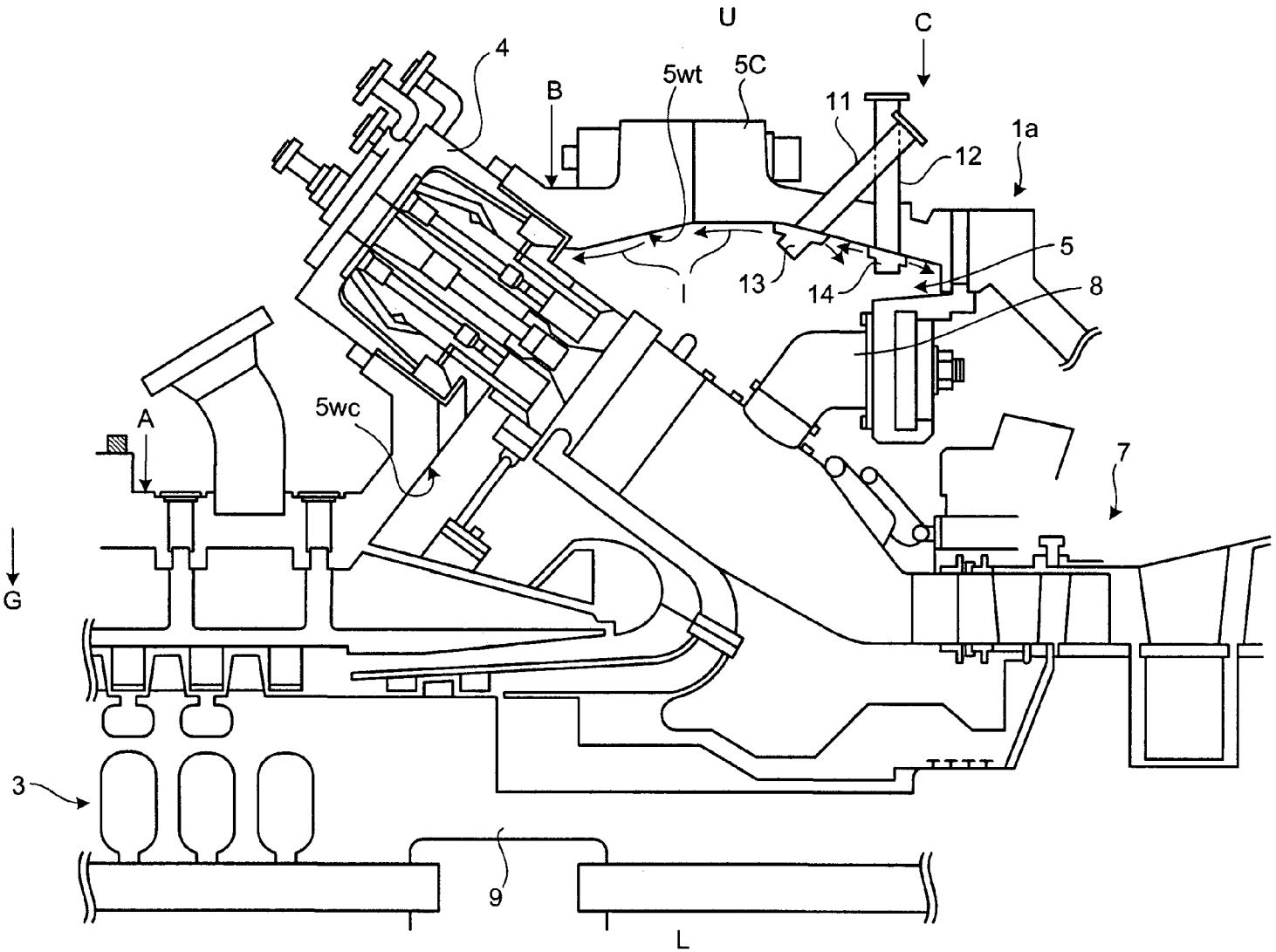
FIG. 5 is a partial sectional view showing a combustor-accommodating chamber portion of a gas turbine according to a second embodiment.
Figure 6:
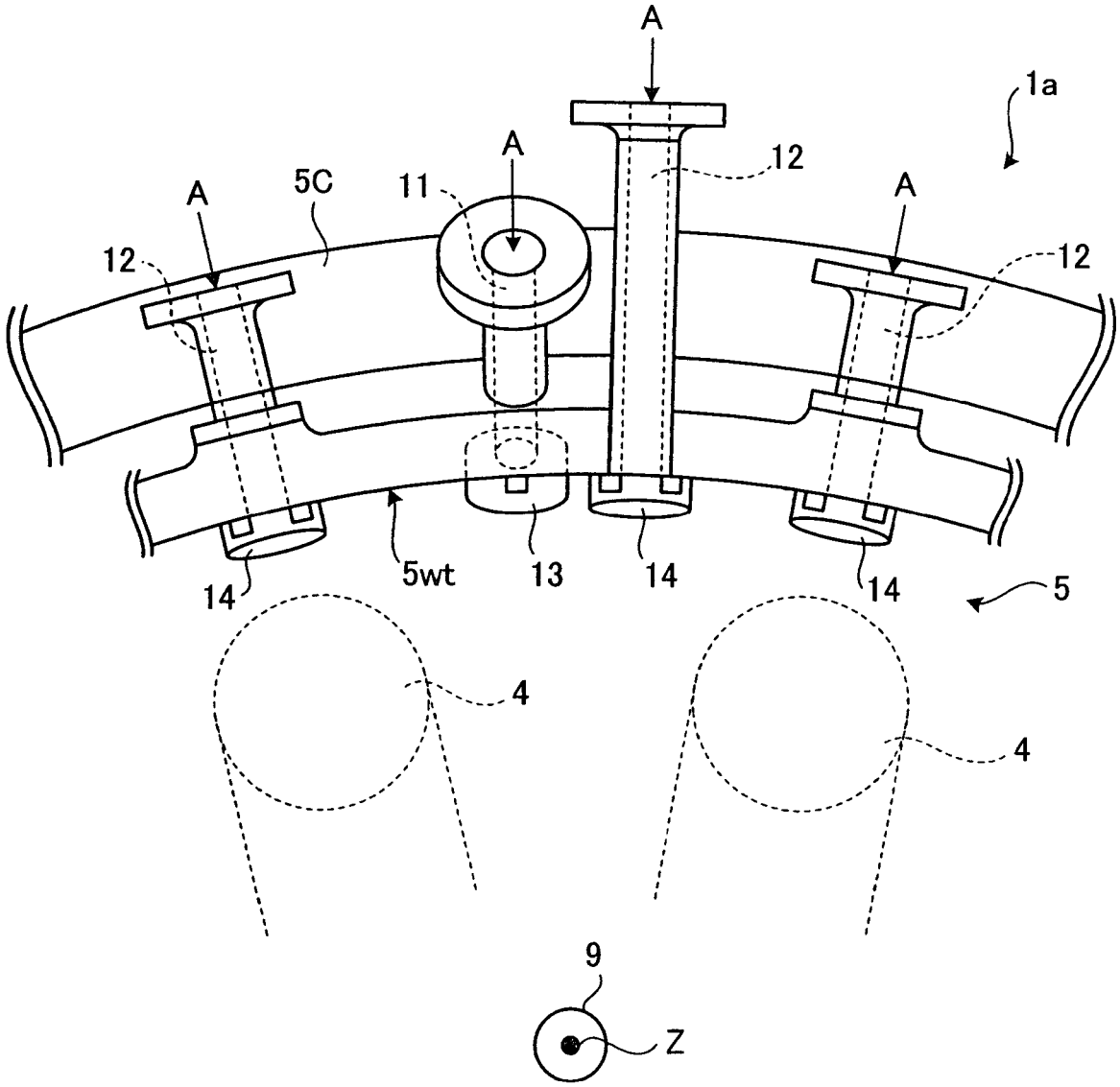
FIG. 6 is an explanatory view of an inside of a combustor-accommodating chamber as viewed from a direction of the arrow D in FIG. 5.

The second embodiment is characterized in that it has air layer forming means for allowing air along an inner wall surface of the combustor-accommodating chamber. In the next description, the same reference numerals (symbols) are given to the same configuration as the first embodiment. FIG. 5 is a partial sectional view showing a combustor-accommodating chamber portion of a gas turbine according to a second embodiment. FIG. 6 is an explanatory view of an inside of a combustor-accommodating chamber as viewed from a direction of the arrow D in FIG. 5.

As shown in FIGS. 5 and 6, the gas turbine 1*a* includes first air supply means (first air supply passage, hereinafter) 11 for discharging air into the combustor-accommodating chamber 5, and second air supply means (second air supply passage, hereinafter) 12. The first air supply passage 11 and the second air supply passage 12 are provided on the side of the upper portion U of the combustor-accommodating chamber 5. As shown in FIG. 5, the passage (passage axial direction) of first air supply passage 11 is inclined with respect to the rotor shaft 9 of the gas turbine 1*a*. The first air supply passage 11 is formed from outside toward inside of the combustor-accommodating chamber casing 5C toward the compressor 3.

The passage (passage axial direction) of the second air supply passage 12 is formed perpendicular to the rotor shaft 9 of the gas turbine 1*a* substantially at right angles. As shown in FIG. 4, the first and second air supply passages 11 and 12 are formed such that their passages (passage axial directions) are directed toward the rotation center axis Z of the rotor shaft 9.

As shown in FIGS. 5 and 6, a first nozzle block 13 which is air layer forming means is provided on a portion where the first air supply passage 11 is opened into the combustor-accommodating chamber 5. A second nozzle block 14 which is air layer forming means is provided on a portion where the second air supply passage 12 is opened into the combustor-accommodating chamber 5. Here, the portion where the first air supply passage 11 is opened into the combustor-accommodating chamber casing 5 is closer to the compressor 3 than the portion where the second air supply passage 12 is opened into the combustor-accommodating chamber 5. With this, the first nozzle block 13 and the second nozzle block 14 can be disposed such that they are deviated in a direction parallel to the rotor shaft 9 of the gas turbine 1*a*.

As a result, air A (arrow I in FIG. 5) discharged from the first and second nozzle blocks 13 and 14 along the inner wall surface 5*wt* (inner wall surface of the combustor-accommodating chamber on the side of the upper portion) of the combustor-accommodating chamber 5 on the side of the upper portion U flows in a wide range of the inner wall surface 5*wt* of the combustor-accommodating chamber on the side of the upper portion. As a result, the temperature distribution of the combustor-accommodating chamber casing 5C can be reduced and the cat back phenomenon can be suppressed more effectively.

Figure 7A:
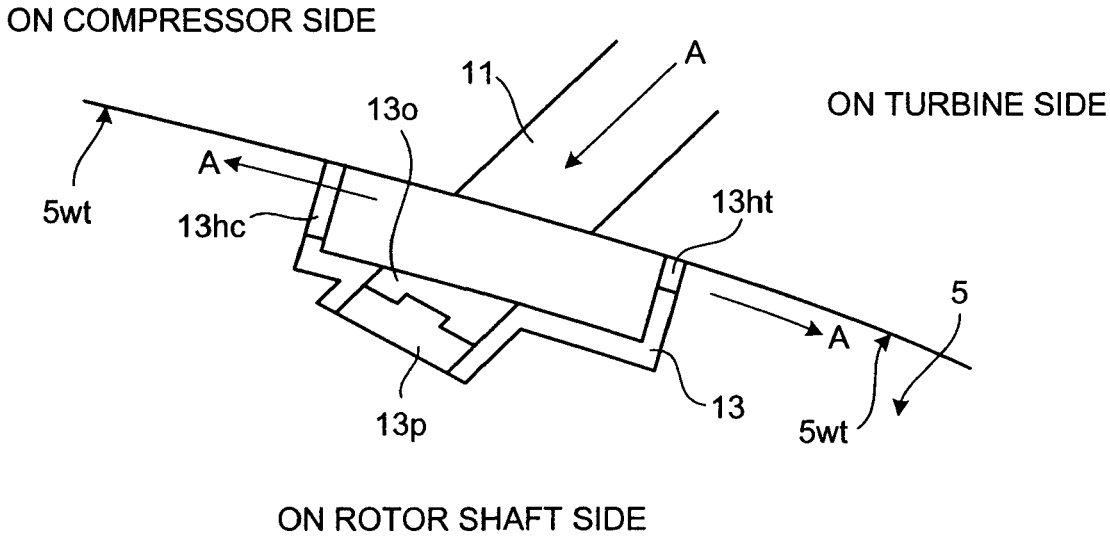
FIG. 7A is an explanatory view showing air layer forming means of the gas turbine of the second embodiment and FIG. 7B is an explanatory view showing the air layer forming means of the gas turbine according to the second embodiment.
Figure 7B:
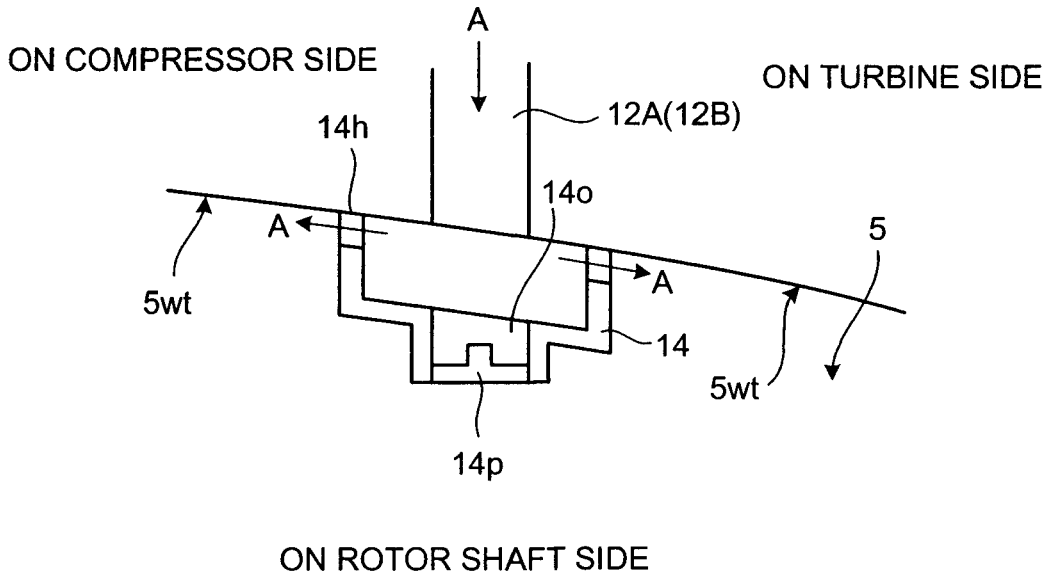
Figure 8:
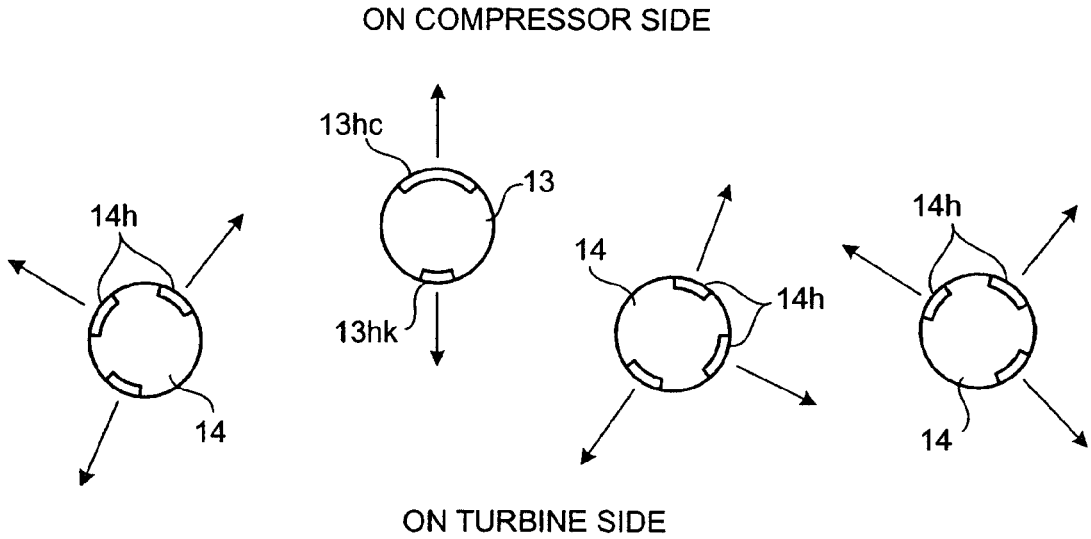
FIG. 8 is an explanatory view showing the air layer forming means as viewed from the inside of the combustor-accommodating chamber of the gas turbine according to the second embodiment.

FIGS. 7A and 7B are explanatory views showing the air layer forming means of the gas turbine of the second embodiment. FIG. 8 is an explanatory view showing the air layer forming means as viewed from the inside of the combustor-accommodating chamber of the gas turbine according to the second embodiment. An upper portion of a sheet surface of FIG. 8 is on the side of the compressor 3. As shown in FIGS. 7A and 8, the first nozzle block 13 is a substantially cup-like structure. A compressor-side air discharging opening 13*hc* is opened in the outer periphery of the first nozzle block 13 on the side of the compressor 3, and a turbine-side air discharging opening 13*ht* is opened in the outer periphery of the first nozzle block 13 on the side of the turbine 7.

The first nozzle block 13 changes the flowing direction of air flowing through the first air supply passage 11, and discharges air on the side of the compressor 3 and turbine 7 along the upper portion-side combustor-accommodating chamber inner wall surface 5*wt*. That is, air A is discharged in a direction parallel to the rotation center axis of the turbine 7. The upper portion of the combustor-accommodating chamber casing 5C becomes relatively long in a direction parallel to the rotation center axis of the turbine 7. With this, cat back phenomenon is generated. If air A is discharged in the direction parallel to the rotation center axis of the turbine 7, the portion which becomes relatively long with respect to the lower potion of the combustor-accommodating chamber casing 5C can efficiently be cooled and thus, the cat back phenomenon can effectively be suppressed with small energy.

As shown in FIGS. 7B and 8, the second nozzle block 14 is a substantially cup-like structure. The second nozzle block 14 is formed with a wall surface-side air discharging opening 14*h*. The flowing direction of air A flowing through the second air supply passage 12 is changed and air A is discharged along the upper portion-side combustor-accommodating chamber inner wall surface 5*wt*.

As shown in FIGS. 7A and 7B, the first and second nozzle blocks 13 and 14 are provided with air discharging openings 13*o* and 14*o* on the side of the rotor shaft 9 of the combustor-accommodating chamber 5. In the second embodiment, the air discharging openings 13*o* and 14*o* are closed with plugs 13*p* and 14*p*, respectively. If the plugs 13*p* and 14*p* are detached, the first and second nozzle blocks 13 and 14 can discharge air toward the rotor shaft 9 of the combustor-accommodating chamber 5 without changing the flowing direction of air A supplied from the first and second air supply passages 11 and 12.

With this structure, according to the gas turbine 1*a* of the second embodiment, air A supplied from the first and second air supply passages 11 and 12 can be allowed to flow along the upper portion-side combustor-accommodating chamber inner wall surface 5*wt* by the first and second nozzle blocks 13 and 14 (arrow I in FIG. 5, FIGS. 7A and 7B). With this, heat conductivity in the upper portion-side combustor-accommodating chamber inner wall surface 5*wt* can be enhanced and thus, the upper portion-side combustor-accommodating chamber inner wall surface 5*wt* can be cooled more effectively than the gas turbine 1 (see FIG. 3 and the like) of the first embodiment. With this, the cat back phenomenon can be suppressed with small energy.

That is, when the same air amount as that of the gas turbine 1 of the first embodiment flows, the temperature difference between the upper portion U and lower portion L of the combustor-accommodating chamber casing 5C can be reduced within shorter time. To obtain the same cooling effect as that of the gas turbine 1 of the first embodiment, the amount of air to be supplied from the first and second air supply passages 11 and 12 can be smaller than that of the gas turbine 1 of the first embodiment. As a result, cat back phenomenon can be suppressed with smaller energy.

At least the plug 13*p* may be eliminated, the air discharging opening 13*o* of at least the first nozzle block 13 may be opened, and air may be discharged from the first nozzle block 13 toward the rotor shaft 9 of the combustor-accommodating chamber 5 and toward the compressor 3. If an air discharging rate between the compressor-side air discharging opening 13*hc*, the wall surface-side air discharging opening 14*h* and the air discharging openings 13*o* and 14*o* are appropriately set, it is possible to obtain both the cooling effect of the upper portion-side combustor-accommodating chamber inner wall surface 5*wt* and the stirring effect of air near the combustor-accommodating chamber inner wall 5*wc*. Further, the first nozzle block 13 may not be used, air A may be discharged from the first air supply passage 11 toward the compressor 3 in the combustor-accommodating chamber 5, and air in the vicinity of the combustor-accommodating chamber inner wall 5*wc* may be stirred, and the upper portion-side combustor-accommodating chamber inner wall surface 5*wt* may be cooled by the second nozzle block 14. With this also, the temperature distribution of the combustor-accommodating chamber 5 can be reduced effectively.

According to the gas turbine 1*a* of this embodiment, in the cross section on the side of the compressor 3 of the combustor-accommodating chamber 5 (cross section shown with arrow A in FIG. 5), the temperature difference between the upper portion U and lower portion L of the combustor-accommodating chamber 5 could be reduced by about 10° C. as compared with the spin cooling. In the cross section near the flange of the combustor-accommodating chamber 5 (cross section shown with arrow B in FIG. 5), the temperature difference between the upper portion U and lower portion L could be reduced by about 80° C. as compared with the spin cooling. In the cross section of the combustor-accommodating chamber 5 on the side of the turbine (cross section shown with arrow C in FIG. 5), the temperature difference between the upper portion U and lower portion L could be reduced by about 100° C. as compared with the spin cooling.

According to the second embodiment, air can flow along the upper portion-side combustor-accommodating chamber inner wall surface 5*wt* of the combustor-accommodating chamber casing. With this, the heat conductivity of the upper portion-side combustor-accommodating chamber inner wall surface 5*wt* can be increased, and the upper portion side of the combustor-accommodating chamber casing can efficiently be cooled. As a result, since the cat back phenomenon can be suppressed more effectively, energy required for supplying air into the combustor-accommodating chamber can further be reduced. Although air is discharged from the upper portion of the combustor-accommodating chamber into the combustor-accommodating chamber in this embodiment, air may be discharged from the lower portion of the combustor-accommodating chamber, i.e., from the lower portion of the combustor into the combustor-accommodating chamber.

Third Embodiment

Figure 9:
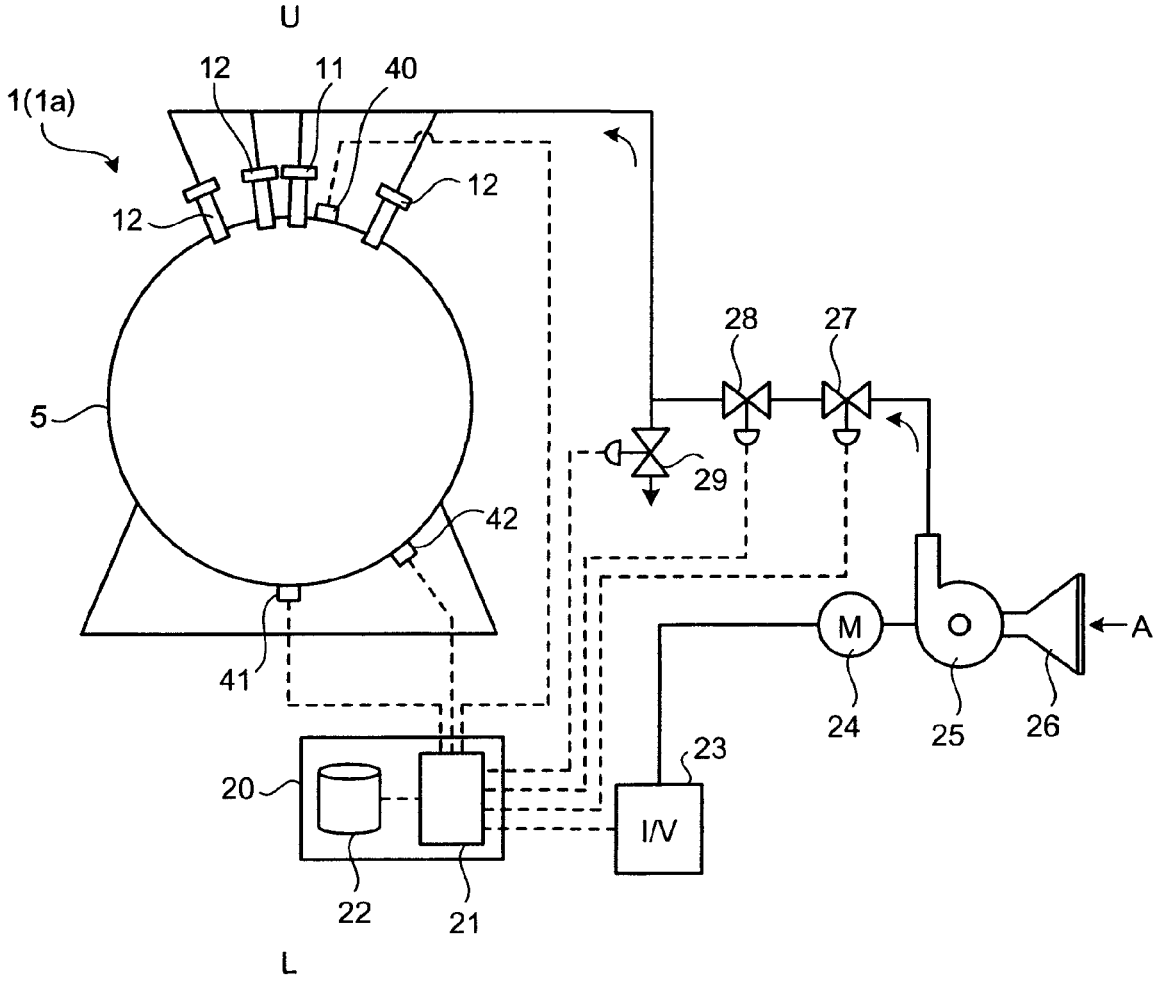
FIG. 9 is a conception diagram showing one example of an air supply system.

In the third embodiment, control of air supply after the operation of the gas turbine according to the first and second embodiment is stopped will be explained. FIG. 9 is a conception diagram showing one example of an air supply system. In this air supply system, an amount of air to be sent into the combustor-accommodating chamber 5 of the gas turbine 1 or 1*a* is adjusted by adjusting a discharging amount of air discharged from air sending means such as a blower, a fan and a compressor.

In the air supply system shown in FIG. 9, air A is supplied into the first and second air supply passages 11 and 12 by a blower 25 driven by a motor 24. Air A is sent into the combustor-accommodating chamber 5 of the gas turbine 1 or gas turbine 1*a*. An air cleaner 26 is mounted on the blower 25, and air A from which dust is removed by the air cleaner 26 is sent out from the blower 25.

The air A sent out from the blower 25 is sent to the first and second air supply passages 11 and 12 through a regulating valve 27 and an interception valve 28. The air A is discharged into the combustor-accommodating chamber 5 from the first and second air supply passages 11 and 12. An air supply control apparatus 20 of this embodiment controls the motor 24 which drives the blower 25 through an inverter 23, thereby adjusting the flow rate of air sent out from the blower 25.

Here, the air supply control apparatus 20 comprises a processing section 21 and a storing section 22. The processing section 21 comprises a memory and a CPU. The processing section 21 reads the computer program into a memory incorporated in the processing section 21 and computes based on the computer program product of the air supply method and the obtained data of the embodiment. The processing section 21 at that time stores a numerical value in the process of computation into the storing section 22 and reads out the stored numerical value and computes. The processing section 21 may use special hardware instead of the computer program product.

In the storing section 22, the computer program of the air supply method according to the present embodiment and the like are stored. The storing section 22 may be a hard disk drive, a magneto-optic disk drive, a nonvolatile memory such as flash memory (read only storing medium such as a CD-ROM), or volatile memory such as a RAM (Random Access Memory) or combination thereof.

The computer program product may be able to realize the air supply method of the embodiment by combination with a computer program recorded in computer system. The computer program for realizing the function of the processing section 21 may be stored in a storing medium that can be read by a computer, the program stored in the storing medium may be read by the computer system, the program may be executed, and the air supply method of the embodiment may be executed. Here, the "computer system" mentioned here includes OS and hardware such as peripheral devices.

The flow rate of air A supplied to the first and second air supply passages 11 and 12 is controlled by the regulating valve 27. The interception valve 28 is always opened, and is closed when the air A supplied to the first and second air supply passages 11 and 12 is stopped. Unnecessary air A in the combustor-accommodating chamber 5 is discharged into atmosphere by a drain valve 29. The regulating valve 27, the interception valve 28 and the drain valve 29 are controlled by the air supply control apparatus 20 of the embodiment.

The air supply control apparatus 20 comprises the processing section 21 and the storing section 22. An upper portion thermometer 40 mounted on the upper portion U of the combustor-accommodating chamber casing 5C, a lower portion thermometer 41 mounted on the lower portion L of the combustor-accommodating chamber casing 5C and a revolution number meter 42 for obtaining the engine revolution number NE of the gas turbine 1 or 1*a* are connected to the processing section 21. The computer program for executing the air supply control of the embodiment is stored in the storing section 22. The processing section 21 controls the operation of the regulating valve 27 and the like and the output value of the inverter 23 based on the computer program stored in the storing section 22 and information obtained from the upper portion thermometer 40.

Figure 10:
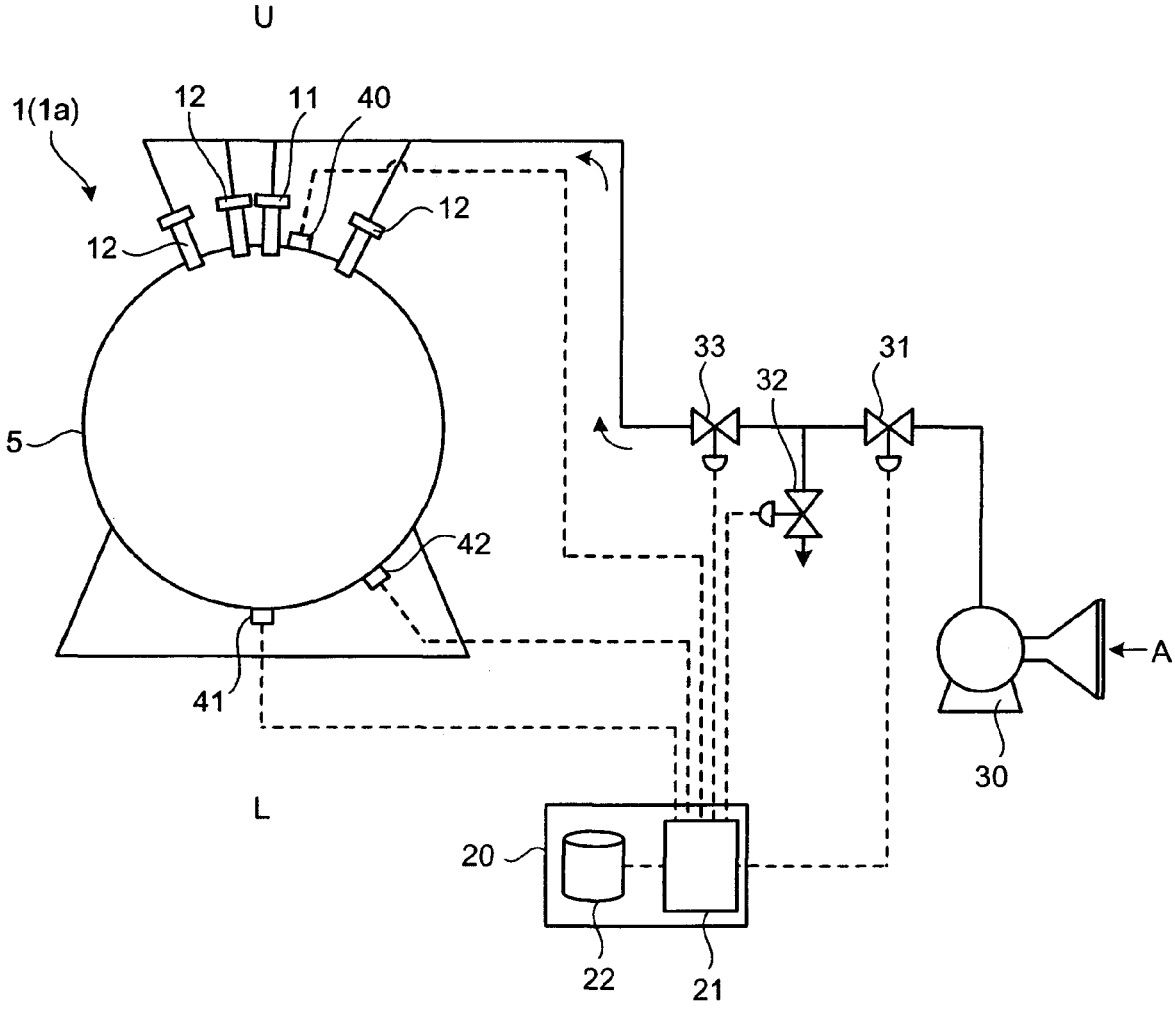
FIG. 10 is a conception diagram showing another example of the air supply system.

Next, another example of the air supply system will be explained. FIG. 10 is a conception diagram showing the other example of the air supply system. In this air supply system, the amount of air sent into the combustor-accommodating chamber 5 of the gas turbine 1 or 1*a* is adjusted by air amount adjusting means provided between the combustor-accommodating chamber 5 and air sending means such as the blower, the fan or the compressor. According to the air supply system shown in FIG. 10, air A is supplied into the first and second air supply passages 11 and 12 by the blower 25 driven by the motor 24. Then, air A is sent into the combustor-accommodating chamber 5 of the gas turbine 1 or 1*a*.

The air A sent out from the blower 25 is sent to the first and second air supply passages 11 and 12 through a flow rate regulating valve 31 and an interception valve 33. Then, the air is discharged into the combustor-accommodating chamber casing 5 from the first and second air supply passages 11 and 12. The air supply control apparatus 20 of the embodiment controls the opening degree of the flow rate regulating valve 31 which is the air amount adjusting means, thereby adjusting the amount of air sent out from the blower 25 and supplied to the combustor-accommodating chamber 5.

The flow rate regulating valve 31 adjusts the pressure of the air A supplied to the first and second air supply passages 11 and 12. The interception valve 33 is always opened, and is closed when the air A to be supplied to the first and second air supply passages 11 and 12 is stopped. Unnecessary air A in the combustor-accommodating chamber casing 5 is discharged into atmosphere by a drain valve 32. The processing section 21 of the air supply control apparatus 20 controls operation of the flow rate regulating valve 31 and the like based on the computer program stored in the storing section 22 and information obtained from the upper portion thermometer 40 and the like. Since the structure of the air supply control apparatus 20 is as described above, explanation thereof will be not repeated. Next, a method of controlling air supply of a third embodiment will be explained.

Figure 11:
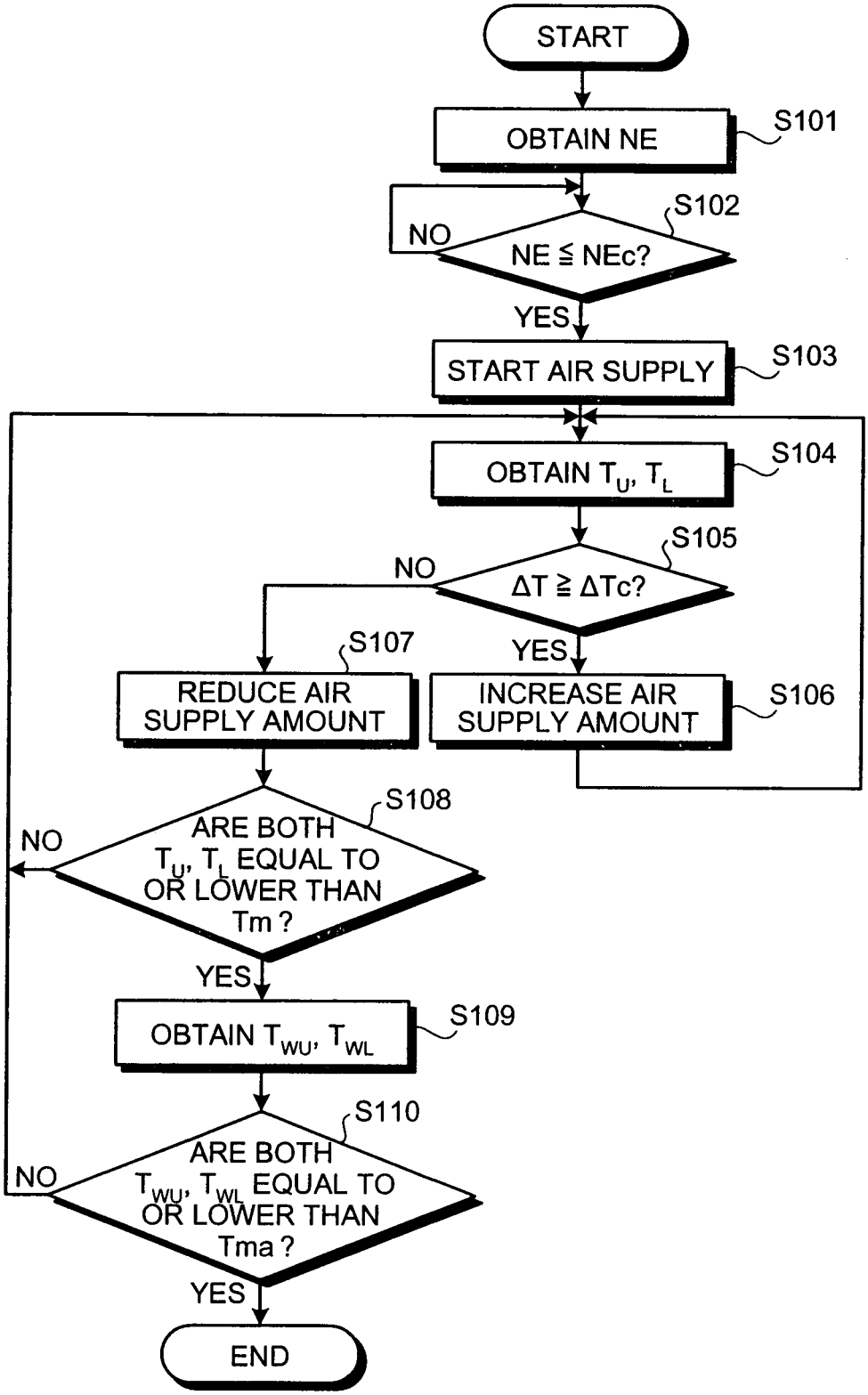
FIG. 11 is a flowchart showing procedure of a method of controlling air supply according to a third embodiment.

FIG. 11 is a flowchart showing procedure of a method of controlling air supply according to the third embodiment. This method of controlling air supply can be applied to any of the gas turbine 1 of the first embodiment, the gas turbine 1*a* of the second embodiment, and the air supply system explained in FIGS. 9 and 10 of the third embodiment. The method of controlling air supply is executed when the operation of the gas turbine 1 or 1*a* is stopped.

When the operation of the gas turbine 1 or 1*a* is stopped, i.e., when the fuel supply to the gas turbine 1 or 1*a* is stopped and the gas turbine 1 or 1*a* does not generate output, the air supply control apparatus 20 starts the control of the air supply of the third embodiment. The processing section 21 of the air supply control apparatus 20 obtains the engine revolution number NE of the gas turbine 1 or 1*a* from the revolution number meter 42 (step S101). At that time, the gas turbine 1 or 1*a* does not generate the output, but the rotor shaft 9 keeps rotating by inertia during the operation.

The processing section 21 compares the obtained engine revolution number NE and predetermined air supply start revolution number NEc with each other, and determines whether or not NE≤NEc (step S102). For example, Nec is set to about 100 rpm to 200 rpm. If NE>NEc (step S102: No), the procedure is brought into a standby state until it becomes NE≤NEc. If NE≤NEc (step S102: Yes), the processing section 21 starts supplying air into the combustor-accommodating chamber casing 5 of the gas turbine 1 or 1*a* (step S103).

When the air supply system shown in FIG. 9 is used, if NE≤NEc is established, the processing section 21 drives the blower 25, opens the regulating valve 27 and the interception valve 28 and closes the drain valve 29. When the air supply system shown in FIG. 10 is used also, if NE≤NEc is established, the processing section 21 drives the blower 30, opens the flow rate regulating valve 31 and the interception valve 33 and closes the drain valve 32. Even when any of the air supply systems is used, air may be supplied into the combustor-accommodating chamber casing 5 from one of the first and second air supply passages 11 and 12.

In the gas turbine, if the revolution number of the rotation shaft is reduced, the temperature difference between the upper and lower portions in the casing is abruptly increased, but if air is supplied to the combustor-accommodating chamber casing 5 before the rotor shaft 9 of the gas turbine 1 or 1*a* is completely stopped, it is possible to suppress the temperature difference between the upper and lower portions in the casing from early stage. With this, it is possible to more effectively suppress the generation of the cat back phenomenon, and to further reduce the energy required for supplying air to the combustor-accommodating chamber.

Next, the processing section 21 obtains, from the upper and lower thermometers 40 and 41, temperature (upper portion temperature) $T_U$ in the upper portion U and temperature $T_L$ (lower portion temperature) in the lower portion L of the casing of the gas turbine 1 or 1*a* (step S104). Next, the processing section 21 calculates a difference (temperature difference between the upper and lower portions) $\Delta T$ ($=T_U-T_L$) between the upper portion temperature $T_U$ and the lower portion temperature $T_L$, and compares the same with a predetermined reference temperature difference $\Delta Tc$. The predetermined reference temperature difference $\Delta Tc$ may be about 10° C. to 20° C.

When $\Delta T \geq \Delta Tc$ (step S105: Yes), the processing section 21 increases the amount of air to be supplied to the combustor-accommodating chamber 5 (step S106). The processing section 21 changes (increases) the amount of air to be supplied to the combustor-accommodating chamber 5 until $\Delta T < \Delta Tc$ is established. The amount of air to be supplied to the combustor-accommodating chamber 5 from at least one of the first and second air supply passages 11 and 12 may be changed (increased).

Since feedback control is performed such that the upper and lower temperature difference $\Delta T$ falls within a predetermined range (predetermined reference temperature difference $\Delta Tc$), cat back phenomenon can effectively be suppressed. Necessary air supply amount is varied due to variation in operation environment, reduction of initial temperature when the gas turbine is stopped or reduction of air temperature in the combustor-accommodating chamber, but according to this control method, it is possible to secure the air supply amount required for suppressing the cat back phenomenon.

As a result, it is possible to suppress the cat back phenomenon more reliably and swiftly, and to reduce the energy consumption required for supplying air to the combustor-accommodating chamber. Excessive air supply can be avoided by supplying sufficient air for suppressing the cat back phenomenon and thus, energy required for air supply can also be reduced.

When the amount of air supplied to the combustor-accommodating chamber 5 is increased, air supply amounts of the first air supply passage 11 and the second air supply passage 12 may be different from each other. When an air layer is formed near the combustor-accommodating chamber inner wall surface as in the gas turbine 1*a* of the second embodiment, the air supply amounts may be different depending upon the direction in which the air layer is formed. At that time, upper and lower temperature of the casing may be obtained on the side of the compressor 3 (A in FIGS. 3 and 5), on the side of the central portion (B in FIGS. 3 and 5) and on the side of the turbine 7 (C in FIGS. 3 and 5), and the air supply amounts may set different based on the measurement result. With this, the upper and lower temperature difference $\Delta T$ can fall within the reference temperature difference $\Delta Tc$ more swiftly using air more efficiently.

When $\Delta T < \Delta Tc$ (step S105: No), there is a possibility that even if the amount of air supplied to the combustor-accommodating chamber 5 is reduced, the upper and lower temperature difference $\Delta T$ falls within the reference temperature difference $\Delta Tc$. Therefore, the processing section 21 adjusts the inverter 23 (FIG. 9) or the flow rate regulating valve 31 (FIG. 10) to reduce the amount of air supplied to the combustor-accommodating chamber 5 (step S107). With this, energy required for the air supply can be reduced. Here, the step 107 may be omitted.

Next, the processing section 21 determines whether or not both of the obtained upper portion temperature $T_U$ and lower portion temperature $T_L$ are equal to or lower than the temperature Tm at the time of stop (step S108). The temperature Tm may be set to room temperature+α° C. When at least one of the upper portion temperature $T_U$ and lower portion temperature $T_L$ is higher than the temperature Tm (step S108: No), steps S104 and S105 are repeated until both of the upper portion temperature $T_U$ and lower portion temperature $T_L$ become equal to or lower than the temperature Tm.

If both of the upper portion temperature $T_U$ and lower portion temperature $T_L$ become equal to or lower than the temperature Tm (step S108: Yes), the processing section 21 obtains air temperature $T_{WU}$ in the combustor-accommodating chamber on the side of the upper portion and air temperature $T_{WL}$ in the combustor-accommodating chamber on the side of the lower portion (step S109). The processing section 21 determines whether or not $T_{WU}$ and $T_{WL}$, are equal to or lower than a predetermined air temperature Tma in the combustor-accommodating chamber (step S110). When at least one of $T_{WU}$ and $T_{WL}$ is higher than Tma (step S110: No), steps S104 and S105 are repeated until both of $T_{WU}$ and $T_{WL}$ become equal to or lower than Tm. If both of $T_{WU}$ and $T_{WL}$ become equal to or lower than Tm (step S110: Yes), this control is completed.

In this embodiment, feedback control is performed such that the temperature difference between the upper portion and the lower portion in the casing of the gas turbine falls within the predetermined range. Therefore, the cat back phenomenon can effectively be suppressed. Even if the necessary air supply amount is varied due to variation of operation environment, reduction of initial temperature at the time of stop of the gas turbine, or reduction of air temperature in the combustor-accommodating chamber, it is possible to secure the necessary air supply amount. As a result, the cat back phenomenon can be suppressed more reliably, and excessive air supply can be avoided. Thus, energy required for air supply can also be reduced. Since excessive air is not supplied, the upper portion of the combustor-accommodating chamber is not contracted relative to the lower portion of the combustor-accommodating chamber.

As mentioned above, the gas turbine, the method of controlling air supply and the computer program product for controlling air supply according to the present invention are effective when the gas turbine is stopped, and they are especially suitable for reducing the energy consumption while suppressing a so-called cat back phenomenon.

According to the gas turbine, deviation in temperature can be suppressed over the entire casing constituting the combustor-accommodating chamber and thus, the cat back phenomenon can effectively be suppressed with small energy.

As in the invention, it is preferable that the second air supply means discharges air toward a lower portion of the combustor-accommodating chamber in the vertical direction. With this, since air in the combustor-accommodating chamber can be stirred more effectively, the temperature distribution of the casing which constitutes the combustor-accommodating chamber can be reduced more effectively. As a result, it is possible to effectively suppress the cat back phenomenon with small energy.

A plurality of combustors are provided as the combustor and the first air supply means discharges air toward a space between the plurality of combustors.

With this, high temperature air staying in the upper portion of the combustor-accommodating chamber is stirred and air in the vicinity of the inner wall of the combustor-accommodating chamber on the side of the compressor is also stirred. As a result, deviation in temperature can be reduced over the entire casing constituting the combustor-accommodating chamber, and the cat back phenomenon can be effectively suppressed with small energy.

When the engine revolution number of the gas turbine becomes smaller than a predetermined revolution number after operation of the gas turbine is stopped, at least one of the first air supply means and the second air supply means discharges air into the combustor-accommodating chamber.

In the gas turbine, if the revolution number of the rotor shaft is reduced, the upper and lower temperature difference in the casing is abruptly increased, but according to this invention, it is possible to suppress the upper and lower temperature difference to a small level from an early stage. With this, since the generation of the cat back phenomenon can be suppressed more effectively, energy required for supplying air to the combustor-accommodating chamber can further be reduced.

An amount of air discharged into the combustor-accommodating chamber from at least one of the first air supply means and the second air supply means is varied based on the temperature of an upper portion of the combustor-accommodating chamber in the vertical direction, and based on the temperature of a lower portion of the combustor-accommodating chamber in the vertical direction.

With this, the cat back phenomenon can be suppressed more reliably and more swiftly. Since excessive air supply can be avoided by supplying sufficient amount of air for suppressing the cat back phenomenon, energy required for air supply can also be reduced.

Since the gas turbine includes air layer forming means, it is possible to flow air along the inner wall surface of the upper portion of the combustor-accommodating chamber. With this, the heat conductivity in the inner wall surface can be enhanced and the upper portion of the casing constituting the combustor-accommodating chamber can be cooled efficiently. As a result, the cat back phenomenon can be suppressed effectively and thus, energy required for supplying air to the combustor-accommodating chamber can further be reduced.

The air layer forming means discharges air in a direction parallel to a rotation center axis of the turbine.

By discharging air in the direction parallel to the rotation center axis of the turbine, it is possible to more efficiently cool a portion of the casing constituting the combustor-accommodating chamber which becomes relatively long with respect to the lower portion in the vertical direction. Therefore, the cat back phenomenon can be effectively suppressed with small energy.

When the engine revolution number of the gas turbine becomes smaller than a predetermined revolution number after operation of the gas turbine is stopped, the air layer forming means discharges air toward the combustor-accommodating chamber.

In the gas turbine, if the revolution number of the rotor shaft is reduced, the upper and lower temperature difference in the casing is abruptly increased, but according to this invention, it is possible to suppress the upper and lower temperature difference to a small level from an early stage. With this, since the generation of the cat back phenomenon can be suppressed more effectively, energy required for supplying air to the combustor-accommodating chamber can further be reduced.

An amount of air discharged from the air layer forming means to the combustor-accommodating chamber is varied based on the temperature of an upper portion of the combustor-accommodating chamber in the vertical direction, and based on the temperature of a lower portion of the combustor-accommodating chamber in the vertical direction.

With this, the cat back phenomenon can be suppressed more reliably and more swiftly. Since excessive air supply can be avoided by supplying sufficient amount of air for suppressing the cat back phenomenon, energy required for air supply can also be reduced.

By the method of controlling air supply, the amount of air discharged to the combustor-accommodating chamber is adjusted such that the difference of the temperature of the upper portion of the combustor-accommodating chamber in the vertical direction and the temperature of the lower portion of the combustor-accommodating chamber in the vertical direction falls within the predetermined range. Therefore, the cat back phenomenon can be suppressed more reliably and more swiftly. Since excessive air supply can be avoided, energy required for air supply can also be reduced.

The air is discharged to the combustor-accommodating chamber after the engine revolution number of the gas turbine becomes smaller than a predetermined revolution number.

In the gas turbine, if the revolution number of the rotor shaft is reduced, the upper and lower temperature difference in the casing is abruptly increased, however according to this invention, it is possible to suppress the upper and lower temperature difference to a small level from an early stage. With this, since the generation of the cat back phenomenon can be suppressed more effectively, energy required for supplying air to the combustor-accommodating chamber can further be reduced.

The computer program product for controlling air supply according the present invention having a computer readable medium including programmed instructions for supplying air into a combustor-accommodating chamber after operation of a gas turbine is stopped, wherein the instructions, when executed by a computer, cause the computer to perform the method of controlling air supply.

What is claimed is:

1. A gas turbine comprising:

a combustor-accommodating chamber for accommodating therein a combustor which burns fuel and air compressed by a compressor to generate combustion gas and which injects the combustion gas to a turbine; and means for forming an air layer by discharging air along an inner wall surface of an upper side of the combustor-accommodating chamber and inside the combustor-accommodating chamber, wherein the means for forming the air layer is provided on the inner wall surface of the combustor-accommodating chamber on a side of its upper portion, and wherein the means for forming an air layer discharges air inside the combustor-accommodating chamber and outside the combustor.

2. The gas turbine according to claim 1, wherein the means for forming an air layer discharges air in a direction parallel to a rotation center axis of the turbine.

3. The gas turbine according to claim 1, wherein when an engine revolution number of the gas turbine becomes smaller than a predetermined revolution number after operation of the gas turbine is stopped, the means for forming an air layer discharges air toward the combustor-accommodating chamber.

4. The gas turbine according to claim 1, wherein an amount of air discharged from the means for forming an air layer to the combustor-accommodating chamber is varied based on a temperature of an upper portion of the combustor-accommodating chamber, and a temperature of a lower portion of the combustor-accommodating chamber.

5. The gas turbine according to claim 1, further comprising a blower driven by a motor to supply air to an air supply passage, wherein the means for forming air layer is disposed at a portion where the air supply passage is opened into the combustor-accommodating chamber, and is connected to the air supply passage.

* * * * *